United States Patent [19]

Shaw

[11] Patent Number: 4,748,831

[45] Date of Patent: Jun. 7, 1988

[54] REFRIGERATION PLANT AND ROTARY POSITIVE DISPLACEMENT MACHINE

[75] Inventor: David N. Shaw, Unionville, Conn.

[73] Assignee: Svenska Rotor Maskiner AB, Nacka, Sweden

[21] Appl. No.: 12,125

[22] PCT Filed: May 2, 1986

[86] PCT No.: PCT/SE86/00202

§ 371 Date: Dec. 29, 1986

§ 102(e) Date: Dec. 29, 1986

[87] PCT Pub. No.: WO86/06798

PCT Pub. Date: Nov. 20, 1986

[30] Foreign Application Priority Data

May 9, 1985 [GB] United Kingdom ..... 8511729

[51] Int. Cl.[4] ..... F25B 31/00

[52] U.S. Cl. ..... 62/505; 62/200

[58] Field of Search ..... 62/197, 200, 505

[56] References Cited

U.S. PATENT DOCUMENTS

| | | | |
|---|---|---|---|
| 2,358,815 | 9/1944 | Lysholm | 417/53 |
| 2,386,198 | 10/1945 | Dodson | 62/200 |
| 2,388,556 | 11/1945 | Lathrop | 62/200 |
| 2,519,913 | 8/1950 | Lysholm | 418/201 |
| 3,022,638 | 2/1962 | Caswell et al. | 62/505 |
| 3,589,140 | 6/1971 | Osborne | 62/197 |
| 3,795,117 | 3/1974 | Moody, Jr. et al. | 62/505 |
| 3,805,101 | 4/1974 | Purman | 62/505 |
| 3,848,422 | 11/1974 | Schibbye | 62/505 |
| 3,859,814 | 1/1975 | Whitney | 62/196 |
| 3,913,346 | 10/1975 | Moody | 62/197 |
| 3,936,239 | 2/1976 | Shaw | 417/315 |
| 4,062,199 | 12/1977 | Kasahara et al. | 62/197 |
| 4,084,405 | 4/1978 | Shibbye et al. | 62/197 |
| 4,316,366 | 2/1982 | Manning | 62/200 |
| 4,498,849 | 2/1985 | Schibbye et al. | 417/299 |

FOREIGN PATENT DOCUMENTS

| | | |
|---|---|---|
| 0060639 | 2/1982 | European Pat. Off. . |
| 2641482 | 3/1978 | Fed. Rep. of Germany . |
| 804327 | 3/1936 | France . |
| 335743 | 7/1968 | Sweden . |
| 403171 | 1/1976 | Sweden . |
| 432465 | 12/1981 | Sweden . |
| 1576230 | 9/1977 | United Kingdom . |
| 2083868 | 9/1980 | United Kingdom . |

*Primary Examiner*—Ronald C. Capossela

*Attorney, Agent, or Firm*—Frishauf, Holtz, Goodman & Woodward

[57] ABSTRACT

A refrigeration type plant comprises a rotary, positive displacement machine which as at least one rotor provided with spiral lobes and intervening grooves. The plant further comprises a condenser communicating with an outlet port (60) of the compressor through a high pressure channel (14), an evaporator communicating with an inlet port (58) of the compressor through a low pressure channel (18), a vessel for an intermediate pressure communicating with an intermediate port (38) of the compressor through an intermediate pressure channel (36), the intermediate port (38) being spaced from the inlet port (58) as well as from the outlet port (60), and a pressure reducer for decreasing the high pressure in the condenser to the intermediate pressure in the vessel and to the low pressure in the evaporator, respectively. A selectively adjustable valve (40) is provided for forming a communication between the intermediate channel (36) and the low pressure channel (18).

24 Claims, 3 Drawing Sheets

REFRIGERATION PLANT AND ROTARY POSITIVE DISPLACEMENT MACHINE

BACKGROUND OF THE INVENTION

The present invention relates to a refrigeration plant of the type comprising a compressor, and a condenser and an evaporator with pressure reduction means therebetween and communicating with the compressor through a high pressure, outlet channel and a low pressure, inlet channel, respectively. The compressor is of a rotary, positive displacement type having at least one rotor provided with spiral lobes and intervening grooves. The plant is further provided with an intermediate pressure vessel communicating with the condenser through pressure reduction means and with intermediate port means in the compressor through an intermediate pressure channel. The invention further relates to a rotary machine appropriate for use as a compressor in such a plant.

Plants and compressors of such types are earlier known from U.S. Pat. No. 3,568,466, Brandin et al., and U.S. Pat. No. 3,913,346, Moody et al. The intermediate pressure zone in such plants is used for internal cooling purposes within the plant at a temperature level above that of the evaporator. The main cooling purpose is to precool the liquified refrigerant before the supply thereof to the evaporator which results in a more effective use of the evaporator area so that the dimensions thereof can be minimized for a certain capacity simultaneously as the swept volume of the compressor and thus its dimensions can be reduced correspondingly. Furthermore the power required for recompression of the gaseous refrigerant supplied at the intermediate pressure will be less than that if all the refrigerant were supplied at the evaporator pressure. A second cooling purpose applicable when the compressor is driven by an electrical motor, especially important in hermetic systems and heat pump applications, is to pass the intermediate pressure fluid through the motor in order to guarantee an efficient cooling thereof under all driving conditions.

Even though the description of the compressor for a refrigeration plant in this specification is restricted to the type comprising two intermeshing rotors of male and female type provided with helical lands and intervening grooves the invention may also be applicable to other types of machines comprising at least one rotor having spiral lobes, for instance compressors of the so called single screw type and of the so called scroll type.

All the machines under consideration relate to such ones where the intermediate pressure port means is spaced from the main inlet port and disposed at such a distance therefrom that any communication therebetween through the working space of the machine is continuously blocked by at least one rotor lobe.

In order to vary the volumetric capacity of a screw compressor it is earlier known from U.S. Pat. No. 3,314,597, Schibbye, to provide the compressor with a selectively adjustable valve member controlling a bleed port in the wall of the working space so that a certain amount of the working fluid supplied to the compressor may be returned to the inlet channel of the compressor. This type of volumetric capacity control has been used also for screw compressors provided with intermediate port means. This bleed port is disposed within the same phase of the compression cycle as the intermediate port means. When the bleed port is opened the pressure level inside the compressor working space decreases to such an extent that the back pressure within the area of the intermediate port means will be practically the same as that in the low pressure channel. The bleed port must in order to avoid throttling losses be provided with a large area corresponding not only for the recirculation of the surplus fluid supplied through the inlet port but also for draining the fluid supplied through the intermediate port means. The size of the valve member will thus be too large for location in the end wall with regard to its area as well as the limited space available outside the rotor bearings. For this reason the valve has to be located in the barrel wall of the working space. Such a valve will consequently be complicated in shape and expensive to manufacture as it not only has to sealingly cooperate with its seat in the housing but also has to sealingly cooperate with the confronting rotor or rotors in order to avoid internal leakage in the compressor, especially when running under maximum capacity conditions.

The main object of the present invention is to achieve a more effective capacity control of the machine per se as well as of a complete plant by means of simpler and less expensive valve arrangements than those used in the prior art.

SUMMARY OF THE INVENTION

This object of the invention is met by providing a selectively adjustable over-flow valve between the intermediate pressure channel and the low pressure channel. In this way the need for a separate bleed port is eliminated as the intermediate pressure port means will act as such a port during low volumetric capacity conditions when only the surplus supply of working fluid has to be drained from the working space. Furthermore, the valve body will be considerably simpler and cheaper as it only has to seal against its seat, whereas there are no requirements whatsoever about the sealing cooperation between the valve body and the rotors.

Other objects of the invention and how those are met will be evident from the following detailed description of a preferred embodiment of the invention shown in the accompanying drawings.

DETAILED DESCRIPTION

Figure 1:
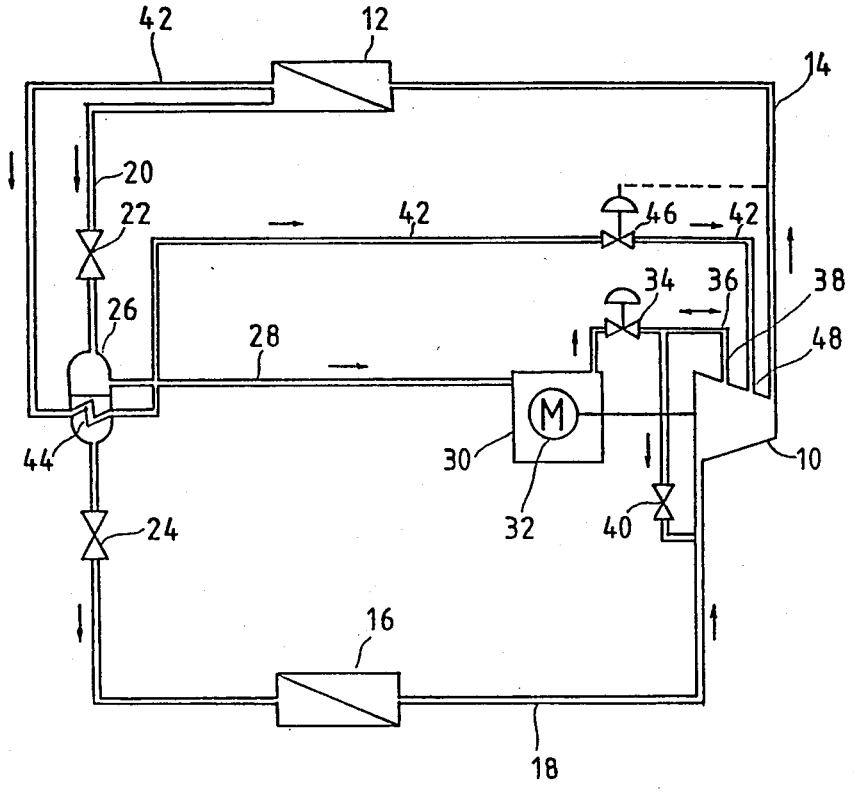
FIG. 1 diagrammatically illustrates an embodiment of a refrigeration plant according to the invention.

A refrigeration plant as shown in FIG. 1 comprises a compressor 10 communicating with a condenser 12 through a high pressure channel 14 and with an evaporator 16 through a low pressure channel 18. The condenser 12 and the evaporator 16 are interconnected by a channel 20 in which two sets of pressure reduction means 22, 24 are disposed, each shaped as a throttling valve. An intermediate pressure vessel 26 in the shape of a flash chamber is disposed between the two throttling valves 22, 24. The flash gas side of the intermediate pressure vessel 26 communicates through a channel 28 with a housing 30 enclosing an electrical motor 32 drivingly connected with the compressor 10. From the housing 30 the flash gas passes through a pressure preservation valve 34 for keeping a minimum pressure in the intermediate pressure section 26, 28, 30 of the plant and an intermediate channel 36 to intermediate port means 38 in the compressor 10. The intermediate channel 36 may further communicate with the low pressure channel 18 through a selectively adjustable valve 40. The plant is further provided with a channel 42 for transferring liquified refrigerant from the condenser 12 through a heat exchanger 44 for cooling of the liquid by the intermediate pressure fluid, and through a valve 46 for control of the liquid flow in dependence of the temperature in the high pressure channel 14, to a liquid injection opening 48 in the compressor 10.

Figure 2:
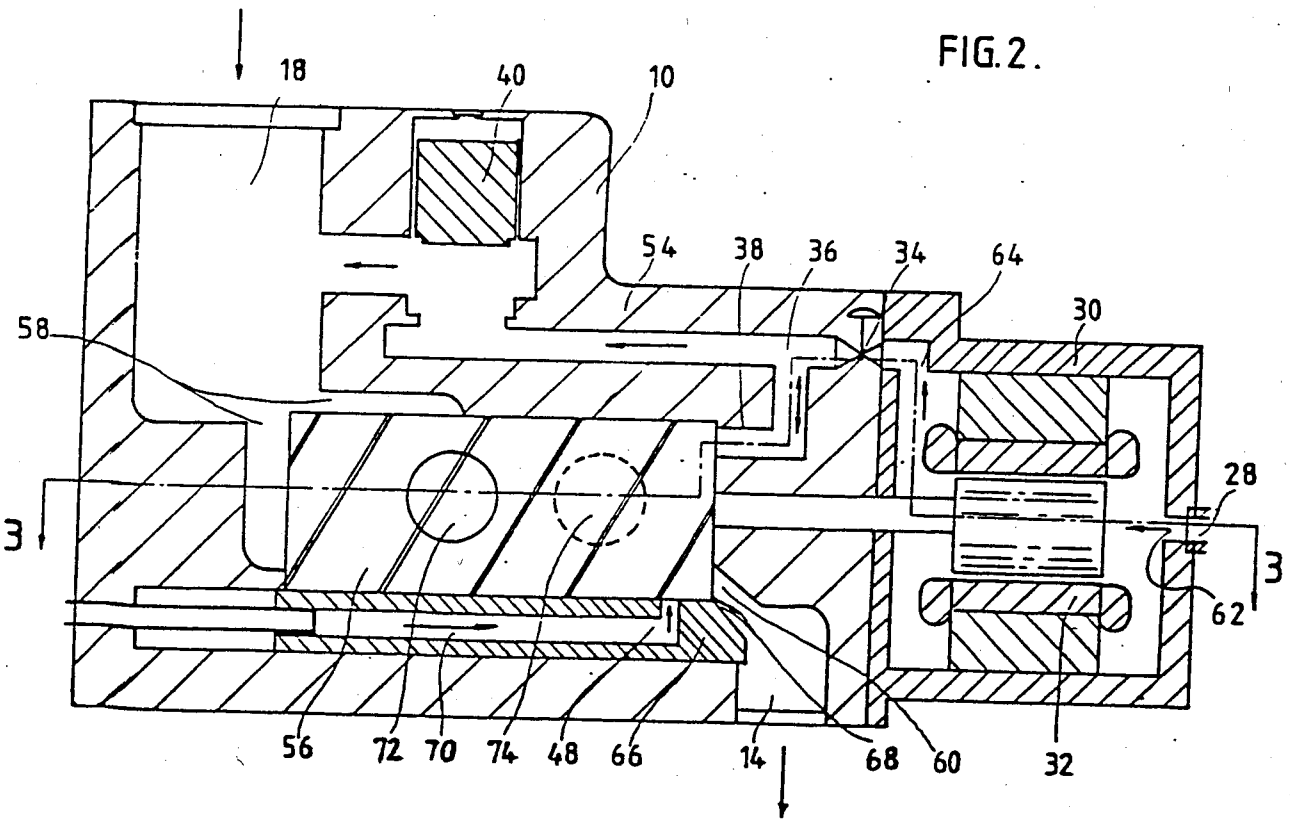
FIG. 2 shows a vertical section through a compressor taken on line 2—2 in FIG. 3.
Figure 3:
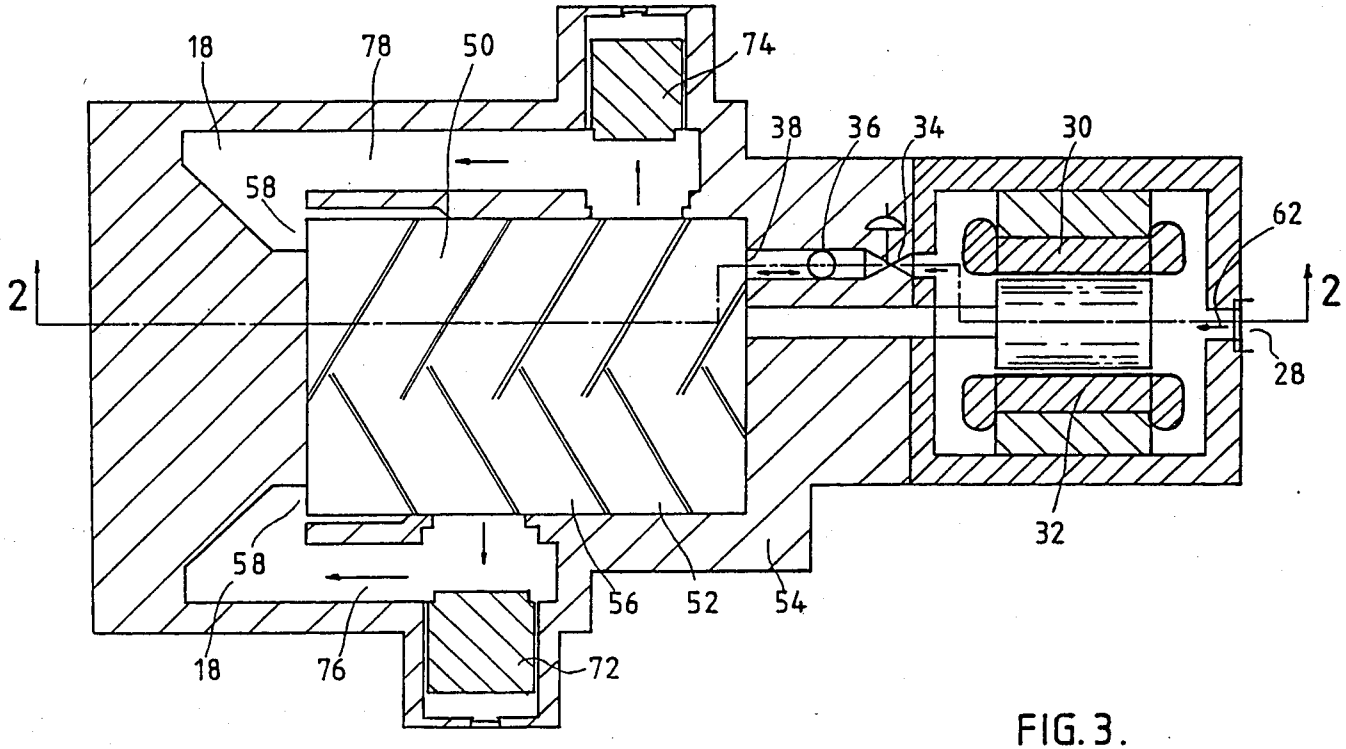
FIG. 3 shows a horizontal section through the compressor of FIG. 2 taken on line 3—3 in FIG. 2.

The compressor 10, shown in FIGS. 2 and 3, is of the intermeshing screw rotor type comprising a male rotor 50 and a female rotor 52 and a casing 54 providing a working space 56 enclosing the rotors and communicating with the low pressure channel through an inlet port 58 and with the high pressure channel 14 through an outlet port 60.

The compressor casing 54 is rigidly connected with a motor housing 30 enclosing an electrical motor 32 coaxial with and directly joined to the male rotor 50. The motor housing 30 is provided with an inlet opening 62 communicating with the channel 28 and with an outlet opening 64 for intermediate pressure fluid passing through the motor 32 for cooling thereof by heat exchaning between the motor and the intermediate pressure fluid. The outlet opening 64 communicates with an adjustable valve 34 provided to keep a certain minimum pressure inside the motor housing 30. The fluid from the valve 34 passes through an intermediate channel 36 to port means shaped as an opening 38 in the high pressure end wall of the working space 56. The opening 38 is disposed at such an angular position that any communication through the working space 56 between said opening 38 and the inlet port 58 is continuously blocked by at least one rotor lobe on each rotor 50, 52. A selectively adjustable valve 40 is provided between the intermediate channel 36 and the low pressure channel 18 to achieve a communication therebetween. The valve 40 and the port opening 38 are so dimensioned in relation to each other that the flow area of the valve is about double that of the port opening.

The compressor 10 is further provided with an axially selectively adjustable valve member 66, generally of the type shown in U.S. Pat. No. 3,088,659, FIG. 1, in the shape of an axially extending body forming a portion of the barrel wall of the working space 56 from the low pressure end wall thereof to the outlet port 60. The end of the valve body 66 facing the outlet port 60 is provided with an edge 68 defining the angular position of the rotors in which the communication with the high pressure channel 14 through the outlet port 60 is initiated. The valve body 66 is provided with an internal channel 70 communicating at one end thereof with the liquid refrigerant channel 42 and forming at its other end the liquid injection opening 48. This opening 48 is disposed such that when the valve member 66 is in its position for maximum size of the outlet port 60 any communication through the working space 56 between said injection opening 48 and the intermediate port opening 38 is continuously blocked by at least one rotor lobe on each rotor 50, 52.

The compressor is further provided with two independent and selectively adjustable bleed valves 72, 74 for return of practically uncompressed working fluid from the working space through each of said bleed valves 72, 74 and a related over-flow channel 76 and 78, respectively, to the low pressure channel 18.

The valves 40, 72, and 74 are all shaped as lift valves selectively operable by pressure fluid available inside the compressor system. The valves 72, 74 are further provided with an end surface curved as the adjacent barrel wall of the working space 56 and adapted to lie in flush therewith when the valve is in closed position.

A plant according to the invention operates in the following way. Compressed gaseous working fluid is delivered from the compressor 10 to the condenser 12 where it is liquified by external cooling means. From the condenser 12 the main mass of the liquified working fluid passes through the first throttling valve 22, whereby the pressure is reduced, to the intermediate pressure vessel 26 where the working fluid is partly evaporated as flash gas and the remaining liquified working fluid is cooled down to the evaporating temperature corresponding to the pressure in the vessel 26. This cooled liquified working fluid passes through the second throttlling valve 24 whereby the pressure is further reduced, to the evaporator 16 where the working fluid is evaporated by external heating means. The low pressure gaseous working fluid is then returned from the evaporator 16 to the compressor 10 inlet 18, recompressed and recirculated to the condenser 12. The flash gas produced in the intermediate pressure vessel 26 is passed through the motor housing 30, where it cools the electrical motor 32. The cooling effect may be further improved by additional supply of some liquified working fluid to the motor housing 30. From this housing the flash gas is then passed on to an intermediate channel 36 disposed within the compressor casing 54 and communicating with port means 38 in the wall of the working space 56 of the compressor 10. Preferably a pressure preservation valve 34 is disposed between the motor housing 32 and the intermediate channel 36 in order to maintain a certain minimum pressure inside the motor housing 32. The port means 38 is shaped as an opening in the high pressure end wall of the working space 56 disposed in such an angular position that it communicates with a rotor groove which by means of a trailing rotor land is always brought out of communication with the inlet port 58.

At full capacity conditions of the plant the compressor 10 is filled to its maximum capacity by low pressure working fluid from the evaporator 16 through the inlet port 58 simultaneously as the intermediate pressure gas used for precooling the liquified working fluid to the evaporator 16 and for cooling the motor 32 is supplied through the intermediate port means 38 to a compression chamber where the pressure has already been increased from the inlet port conditions. In this way the power for recompression of the gas supplied through the intermediate port means is reduced as the compression thereof starts at a higher pressure level than the inlet pressure of the compressor. Simultaneously the full capacity of the compressor can be used for the gas from the evaporator which means that for a certain capacity of the plant the dimensios of the compressor can be reduced.

In order to achieve part load conditions the valve 40 between the intermediate channel 36 and the inlet channel 18 is opened. In this way the intermediate pressure fluid instead of entering through the intermediate port means 38 is by-passed the compressor 10 to the inlet channel 18 and thus replaces some of the gas otherwise sucked in from the evaporator 16. The intermediate port means 38 will further instead of acting as an additional inlet port acts as a bleed port for negligibly compressed gas returning through the intermediate channel 36 and the valve 40 to the inlet channel 18, whereby the capacity of the compressor 10 is further reduced, resulting in still less working fluid to pass through the evaporator 16 so that the capacity of the plant is considerably reduced. By the pressure preservation valve 34 the pressure in the motor housing 32 and thus in the intermediate pressure vessel 26 is kept on such a level that the evaporator 16 is continuously supplied with an amount of working fluid equal to that sucked in therefrom by the compressor 10. When running under such part load conditions the pressure level inside the compressor is reduced such that the pressure in a compression chamber just cut off from the intermediate port 38 will be equal to that in the inlet channel 18 instead of equal to the intermediate pressure vessel 26 when running at full load, whereas the pressure in the condenser 12 will be practically constant as it depends upon the pressure correspoding to the condensation temperature. In order to obtain a good efficiency the outlet port 60 has to be reduced so that the built-in volume ratio has to be changed such that the built-in pressure ratio corresponds to the ratio between the condensation and the evaporation pressures. The size of the outlet port 60 is changed by adjustment of adjustable valve 66.

In order to improve the sealing and especially the cooling of the gas during compression within the compressor 10 liquified working fluid from the condenser 12 is injected into the compressor 10 through the injection opening 48 disposed such that the liquid is injected into a rotor groove after that said groove is cut off from the intermediate port 38 so that no liquid can pass directly from the injection opening 48 to the intermediate port 38. The amount of liquid to be injected is adjusted by the valve 46 in order to keep the temperature in the high pressure channel 14 at an almost constant temperature being only somewhat higher than the temperature in the condenser 12.

Further reduction of the capacity of the compressor 10 and of the plant can be obtained in steps by means of the two bleed valves 70, 74 disposed in different angular positions in relation to the rotor grooves.

I claim:

1. A plant of the refrigeration type, comprising:

a rotary positive displacement compressor having an inlet port, an outlet port, intermediate port means communicating with a working space of said compressor, and at least one rotor, said at least one rotor being provided with spiral lobes and intervening grooves;

a condenser communicating with an outlet port of said compressor through a high pressure channel;

an evaporator communicating with an inlet port of said compressor through a low pressure channel;

a vessel for an intermediate pressure communicating with said intermediate port means of said compressor through an intermediate pressure channel;

said intermediate port means being in communication with a compression chamber in said working space, said compression chamber being spaced from said inlet port and also being spaced from said outlet port;

pressure reduction means for decreasing high pressure in said condenser to an intermediate pressure in said vessel and to a low pressure in said evaporator, respectively; and a branch channel coupling said low pressure channel with said intermediate pressure channel, said branch channel being provided with selectively adjustable valve means, said selectively adjustable valve means having an open position for allowing gas to flow to said low pressure channel from said intermediate pressure vessel and from said compression chamber in said working space with communicates with said intermediate port means.

2. The plant of claim 1, wherein said adjustable valve means has a maximum open position in which the flow area of said adjustable valve means is larger than the flow area of said intermediate port means.

3. The plant of claim 1 or 2, wherein said intermediate port means is disposed in a high pressure end wall of said compressor.

4. The plant of claim 1 or 2, wherein said compressor further comprises:

at least one bleed port communicating with said inlet port and disposed in a wall of said working space of said compressor; and an additional, selectively adjustable valve means cooperating with said at least one bleed port such that the volumetric capacity of said compressor may be further reduced.

5. The plant of claim 4, wherein said intermediate port means is disposed in a high pressure end wall of said compressor.

6. The plant of claim 1 or 2, wherein said compressor comprises at least one injection opening for receiving liquified refrigerant injected therein, said at least one injection opening being spaced from said intermediate port means and being disposed such that any communication between said at least one injected opening and said intermediate port means through said working space is continuously blocked by at least one rotor lobe.

7. The plant of claim 6, wherein said intermediate port means is disposed in a high pressure end wall of said compressor.

8. The plant of claim 6, wherein said compressor further comprises:

at least one bleed port communicating with said inlet port and disposed in a wall of said working space of said compressor; and an additional, selectively adjustable valve means cooperating with said at least one bleed port such that the volumetric capacity of said compressor may be further reduced.

9. The plant of claim 6, comprising means for cooling the liquified refrigerant to be injected into said at least one injection opening by means of intermediate pressure fluid in said intermediate pressure vessel before the injection thereof.

10. The plant of claim 1 or 2, wherein said compressor comprises an adjustable valve member for variation of the size of said outlet port in dependence of at least one of the adjustment of said selectively adjustable valve means and the actual temperatures in said condenser and said evaporator.

11. The plant of claim 10, wherein said adjustable valve member is slidable in the axial direction of said compressor and comprises an edge determining the angular position of a cooperating rotor in which a communication is formed between a compression chamber of said compressor and said high pressure channel.

12. The plant of claim 11, further comprising means coupled to said axially slidable valve member for adjusting said axially slidable valve member between at least three different positions thereof.

13. The plant of claim 11, further comprising means coupled to said axially slidable valve member for continuously adjusting said axially slidable valve member between two extreme positions thereof.

14. The plant of claim 1 or 2, further comprising:

a motor drivingly coupled to said compressor; and a heat exchanger for cooling said motor, said heat exchanger being disposed within an intermediate pressure section of the plant.

15. The plant of claim 1 or 2, wherein said intermediate pressure vessel and said evaporator are provided in series with a pressure reduction means coupled therebetween, whereby said intermediate pressure vessel acts as a flash chamber producing flash gas of said intermediate pressure.

16. A rotary, positive displacement compressor comprising:

a housing means defining a working space;

at least one rotor in said housing means, said at least one rotor having spiral lobes and intervening grooves at least partly defining compression chambers in said housing means for an elastic working fluid;

said housing means being provided with an inlet port communicating with an inlet channel, an outlet port communicating with an outlet channel, and intermediate port means communicating with an intermediate pressure source through an intermediate pressure channel, said intermediate port means being spaced from said inlet port and also being spaced from said outlet port; and a branch channel coupling said intermediate pressure channel with said inlet channel, said branch channel being provided with selectively adjustable valve means, said selectively adjustable valve means having an open position for forming a communication between said inlet channel and said intermediate pressure source, and for also forming a communication between said inlet channel and a compression chamber in the machine which communicates with said intermediate port means.

17. The compressor of claim 16, in combination with a plant of the refrigeration type, which plant further comprises a condenser communicating with said outlet channel, an evaporator communicating with said inlet channel, a vessel for an intermediate pressure forming said intermediate pressure source, and pressure reduction means for decreasing a high pressure in said condenser to an intermediate pressure in said vessel and to a low pressure in said evaporator, respectively, said compressor being provided with an adjustable valve member for variation of said outlet port in dependence of at least one of the adjustment of said selectively adjustable valve means and the actual temperatures in said condenser and said evaporator.

18. The compressor 17, wherein said adjustable valve member is slidable in an axial direction and is provided with an edge determining an angular position of a cooperating rotor in which a communication is formed between a compression chamber and said high pressure channel.

19. The compressor 18, further comprising means for adjusting said axially slidable valve member between two extreme positions thereof.

20. The compressor of any one of claims 17, 18 and 19, wherein said compressor further comprises:

at least one bleed port communicating with said inlet channel and disposed in a wall of said working space; and additional, selectively adjustable valve means cooperating with said at least one bleed port such that the volumetric capacity of the compressor may be further reduced.

21. The compressor of claim 20, wherein said compressor is provided with at least one injection opening for receiving a liquified refrigerant injected therein, said at least one injection opening being spaced from said intermediate port means and being disposed such that any communication between said at least one injection opening and said intermediate port means through said working space is continuously blocked by at least one rotor lobe.

22. The compressor of any one of claims 17, 18 and 19, wherein said compressor is provided with at least one injection opening for receiving a liquified refrigerant injected therein, said at least one injection opening being spaced from said intermediate port means and being disposed such that any communication between said at least one injection opening and said intermediate port means through said working space is continuously blocked by at least one rotor lobe.

23. The compressor of any one of claims 17, 18 and 19, in which the flow area of said adjustable valve means between said intermediate pressure channel and said inlet channel in its maximum open position is larger than the area of said intermediate port means.

24. The compressor of claim 17, wherein said intermediate port means is disposed in a high pressure end wall of said compressor.

* * * * *